US009387376B1

(12) United States Patent
Hall et al.

(10) Patent No.: US 9,387,376 B1
(45) Date of Patent: Jul. 12, 2016

(54) SLIDABLE WEIGHT ASSEMBLY

(71) Applicant: CALLAWAY GOLF COMPANY, Carlsbad, CA (US)

(72) Inventors: J. Neil Hall, Carlsbad, CA (US); Matthew Myers, Carlsbad, CA (US)

(73) Assignee: CALLAWAY GOLF COMPANY, Carlsbad, CA (US)

( * ) Notice: Subject to any disclaimer, the term of this patent is extended or adjusted under 35 U.S.C. 154(b) by 355 days.

(21) Appl. No.: 14/216,971

(22) Filed: Mar. 17, 2014

Related U.S. Application Data

(63) Continuation-in-part of application No. 14/153,722, filed on Jan. 13, 2014, now Pat. No. 9,199,145, which is a continuation of application No. 14/033,218, filed on Sep. 20, 2013, now Pat. No. 8,696,491, which is a continuation-in-part of application No. 13/923,571, filed on Jun. 21, 2013, now Pat. No. 9,084,921, which is a continuation-in-part of application No. 13/778,958, filed on Feb. 27, 2013, now Pat. No. 8,894,506.

(60) Provisional application No. 61/940,288, filed on Feb. 14, 2014, provisional application No. 61/727,608, filed on Nov. 16, 2012.

(51) Int. Cl.
*A63B 53/04* (2015.01)
*A63B 53/06* (2015.01)

(52) U.S. Cl.
CPC ..... *A63B 53/06* (2013.01); *A63B 2053/0491* (2013.01); *A63B 2053/0495* (2013.01)

(58) Field of Classification Search
USPC ..... 473/324–350
See application file for complete search history.

(56) References Cited

U.S. PATENT DOCUMENTS

| | | | | |
|---|---|---|---|---|
| 7,611,424 | B2 * | 11/2009 | Nagai | A63B 53/0466 473/334 |
| 7,775,905 | B2 * | 8/2010 | Beach | A63B 53/0466 473/256 |
| 8,016,694 | B2 * | 9/2011 | Llewellyn | A63B 53/0466 473/334 |
| 8,192,303 | B2 * | 6/2012 | Ban | A63B 53/0466 473/335 |
| 8,202,175 | B2 * | 6/2012 | Ban | A63B 53/0466 473/334 |
| 8,696,491 | B1 * | 4/2014 | Myers | A63B 53/06 473/334 |
| 8,870,678 | B2 * | 10/2014 | Beach | 473/334 |
| 8,894,506 | B1 * | 11/2014 | Myers | A63B 53/0466 473/334 |
| 8,944,934 | B2 * | 2/2015 | Yamamoto | A63B 53/0466 473/334 |
| 9,211,453 | B1 * | 12/2015 | Foster | A63B 53/06 |
| 9,238,162 | B2 * | 1/2016 | Breier | A63B 53/0466 |
| 9,289,660 | B1 * | 3/2016 | Myers | A63B 53/06 |
| 2006/0122004 | A1 * | 6/2006 | Chen | A63B 53/0466 473/335 |
| 2006/0172821 | A1 * | 8/2006 | Evans | A63B 53/0466 473/349 |
| 2006/0240908 | A1 * | 10/2006 | Adams | A63B 53/0466 473/334 |
| 2008/0261715 | A1 * | 10/2008 | Carter | A63B 53/0466 473/291 |

FOREIGN PATENT DOCUMENTS

JP 2006320493 A * 11/2006

* cited by examiner

*Primary Examiner* — Alvin Hunter
(74) *Attorney, Agent, or Firm* — Rebecca Hanovice; Michael Catania; Sonia Lari

(57) ABSTRACT

A golf club head comprising a channel or a pair of parallel rails and a slidable weight assembly that can be removably fixed at any point within the channel or to the rails is disclosed herein. The slidable weight assembly preferably comprises a weight portion and base that can be turned 45 to 90 degrees to reversibly fix the slidable weight assembly within the channel or to the rails.

19 Claims, 10 Drawing Sheets

SLIDABLE WEIGHT ASSEMBLY

CROSS REFERENCES TO RELATED APPLICATIONS

The present application claims priority to 61/940,288, filed on Feb. 14, 2014, and is a continuation-in-part of U.S. patent application Ser. No. 14/153,722, filed on Jan. 13, 2014, which is a continuation of U.S. patent application Ser. No. 14/033,218, filed on Sep. 20, 2013, which is a continuation-in-part of U.S. patent application Ser. No. 13/923,571, filed on Jun. 21, 2013, which is a continuation-in-part of U.S. patent application Ser. No. 13/778,958, filed on Feb. 27, 2013, which claims priority to U.S. Provisional Patent Application No. 61/727,608, filed on Nov. 16, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a slidable weight assembly for use with sporting goods, such as a golf club head. More specifically, the present invention relates to a slidable weight for a golf club head that can be adjusted along a continuous channel.

2. Description of the Related Art

The ability to adjust center of gravity location and weight in the head of driving clubs is useful for controlling performance of the golf club. The prior art includes several different solutions for adjustable weighting, but these solutions do not optimize weight adjustment. There is a need for a weighting mechanism that allows for simple and flexible center of gravity (CG) and moment of inertia (MOI) adjustability.

BRIEF SUMMARY OF THE INVENTION

The present invention is a novel way of working with adjustable products. The present invention allows consumers to easily move and fix a weight at any location within a channel disposed in a piece of sporting goods equipment, and particularly a golf club head, in such a way to maximize aesthetic appearances while preserving the function of the movable weight. The objective of this invention is to provide an adjustable weight with minimal or no effect on appearance at address while maximizing the ability of the weight to adjust center of gravity height. Additional goals include minimizing the fixed component of the structure dedicated to the weighting system and also minimizing any potential effect on impact sound. Yet another object of the present invention is an adjustable weighting feature for lateral or vertical center of gravity control which is placed to maximize effectiveness and may be entirely concealed from view at address.

One aspect of the present invention is a slidable weight comprising a clamping mechanism with a cam feature that, when turned 90 degrees, causes a combined clamping and pull-down effect that fixes the weight within a channel, which may be disposed in any sporting equipment but particularly in a golf club head.

Another aspect of the present invention is a slidable weight assembly comprising a weight portion comprising a through bore having a first diameter, a base comprising an upper lip having a second diameter, a keyed bore, a neck, and a foot having a long side with a first length and a short side with a second length, and a retaining ring, wherein the first length is greater than the second length, wherein the neck is disposed within the through bore, and wherein each of the second diameter, the first length, and the second length is greater than the first diameter. In some embodiments, the weight portion may comprise a pair of hooked edges. In another embodiment, the foot may be rectangular or oval-shaped. In another embodiment, the weight portion may be composed of a first material having a first density, the base may be composed of a second material having a second density, and the first density may be greater than the second density. In a further embodiment, the weight portion may be composed of a tungsten alloy and the base may be composed of a polymeric material. In a further embodiment, the weight portion may comprise a ring-shaped recess sized to receive the retaining ring. In another embodiment, the keyed bore may be sized to receive a tool.

Yet another aspect of the present invention is a golf club head comprising a body comprising a channel and the slidable weight assembly described above, wherein the channel comprises a longitudinal axis, a floor having a first width, a first rail, a second rail, and an opening having a second width, wherein the first width is greater than the second width, wherein the first width is greater than the second length, wherein the first length is greater than or equal to the first width, wherein the foot is disposed within the channel, wherein the neck extends through the opening, wherein the slidable weight is capable of moving within the channel when the long side is parallel with the longitudinal axis, and wherein turning the foot approximately 90 degrees within the channel reversibly fixes the slidable weight assembly within the channel. In some embodiments, the golf club head may be a wood-type golf club head such as a driver-type golf club head. In a further embodiment, the weight portion may comprise a pair of hooked edges, each of which may extend over one of the first and second rails of the channel. In another embodiment, turning the foot may pull the weight portion towards the channel floor. In yet another embodiment, the body may comprise a crown, a sole, and a face, and the channel may be disposed on the sole. In another embodiment, the channel may be in communication with a weight port, and the slidable weight assembly may be sized to fit within the weight port to access the channel.

Another aspect of the present invention is a slidable weight assembly comprising a weight portion comprising a through bore, and a cam comprising a top portion, a keyed bore, a neck, and a base having a long side with a first length and a short side with a second length, wherein the first length is greater than the second length, wherein the neck is disposed within the through bore, and wherein the keyed bore is sized to receive a tool. In some embodiments, the through bore may comprise a first diameter, the top portion may comprise a second diameter, and each of the second diameter, the first length, and the second length may be greater than the first diameter. In other embodiments, the weight portion may comprise a pair of hooked edges. In one embodiment, the base may have a shape selected from the group consisting of oval and eye-shaped.

In a further embodiment, the weight portion may be composed of a first material having a first density, the cam may be composed of a second material having a second density, and the first density may be greater than the second density. In a further embodiment, the weight portion may be composed of a tungsten alloy and the base may be composed of a polymeric material. In some embodiments, the slidable weight assembly may comprise a retainer ring, and the weight portion may comprise a ring-shaped recess sized to receive the retainer ring. In other embodiments, the through bore may comprise a keyed opening, the top portion may be shaped to fit within the keyed opening, and turning the cam may reversibly lock the weight portion to the cam. In a further embodiment, the keyed opening may comprise a pair of extensions extending inwards from a lower surface of the weight portion, and in another embodiment, at least a part of the top portion may rest on the extensions when the weight portion is reversibly locked to the cam.

Yet another aspect of the present invention is a golf club head comprising a body comprising a first rail and a second rail that are spaced from, and extend parallel to, one another; and the slidable weight assembly described herein, wherein the first rail and second rail form a channel having a floor with a first width and an upper opening with a second width, wherein the first width is greater than the second width, wherein the base is disposed within the channel, wherein the neck extends through the upper opening, wherein a majority of the weight portion is disposed above the first and second rails, wherein the slidable weight assembly is movable between the first and second rails when the long side of the base is oriented so that it is parallel with the first and second rails, and wherein turning the cam by 45 to 90 degrees reversibly fixes the slidable weight assembly to the first and second rails. In some embodiments, the golf club head may comprise a recessed area, and the first and second rails may be disposed within the recessed area. In a further embodiment, the recessed area may be in communication with a weight port, and the slidable weight assembly may be sized to fit within the weight port to access the first and second rails.

In another embodiment, at least one of the first and second rails may comprise an inner wall that forms an angle with the floor, and the angle may be less than 90°, more preferably between 45° and 85°, and most preferably approximately 70°. In some embodiments, at least one of the first and second rails may have a thickness of less than 0.100 inch, and in other embodiments, the first and second rails may be spaced from one another by a distance of between 0.500 and 1.00 inch. In another embodiment, the golf club head may include a pair of small rails extending from a lower surface of the weight portion, and the small rails may rest against, and space the lower surface from, the first and second rails.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
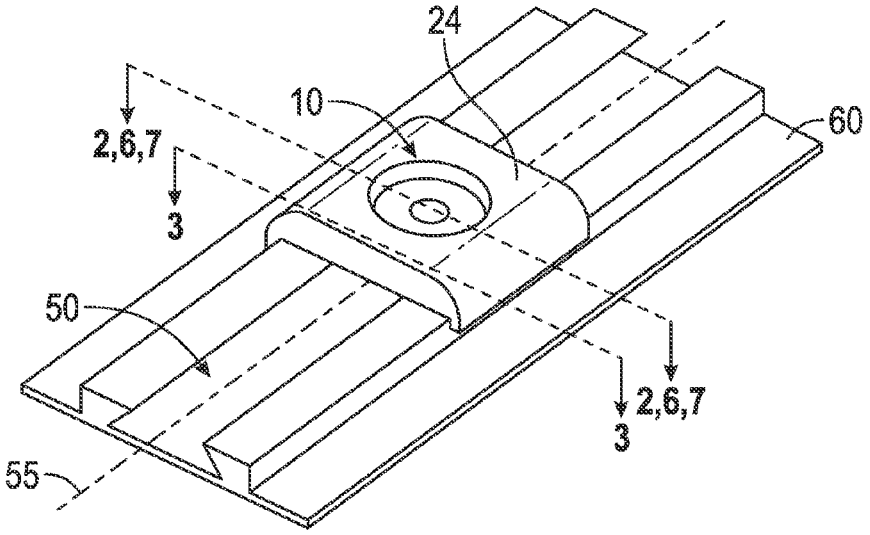
FIG. 1 is a top perspective view of a first embodiment of the slidable weight assembly of the present invention engaged with a channel.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. It can also work in conjunction with at least one adjustable weight port on the sole of the driver head. Shifting weight along the channel described herein allows for control of center of gravity location. The slidable weight assembly 10 of the present invention can be used with any sporting goods equipment having a channel, but preferably is used with golf clubs such as woods, irons, putters, and hybrids.

A first embodiment of the slidable weight assembly 10 of the present invention is shown in FIGS. 1-7. As shown in these Figures, the slidable weight assembly 10 comprises a weight portion 20, a base 30 having a foot 34 with a length L that is greater than its width W and a keyed bore 36 sized to receive a tool (not shown), and a retainer ring 40 that holds the slidable weight assembly 10 together when it is adjusted with the tool. Each of these pieces preferably has the volume and mass shown in Table I below. In some embodiments, the weight portion 20 is composed of a material having a high density, such as a tungsten alloy, the base 30 is composed of a lightweight material such as aluminum, plastic, or composite, and the retainer ring 40 is composed of a strong material such as plastic, hard rubber, titanium, steel, or other metal alloys.

TABLE 1

| Component | Volume in$^3$ | g |
|---|---|---|
| Weight | 0.068 | 8.6 |
| Base | 0.022 | 2.7 |
| Retainer Ring | 0.001 | 0.2 |
| Total | | 11.5 |

Figure 2:
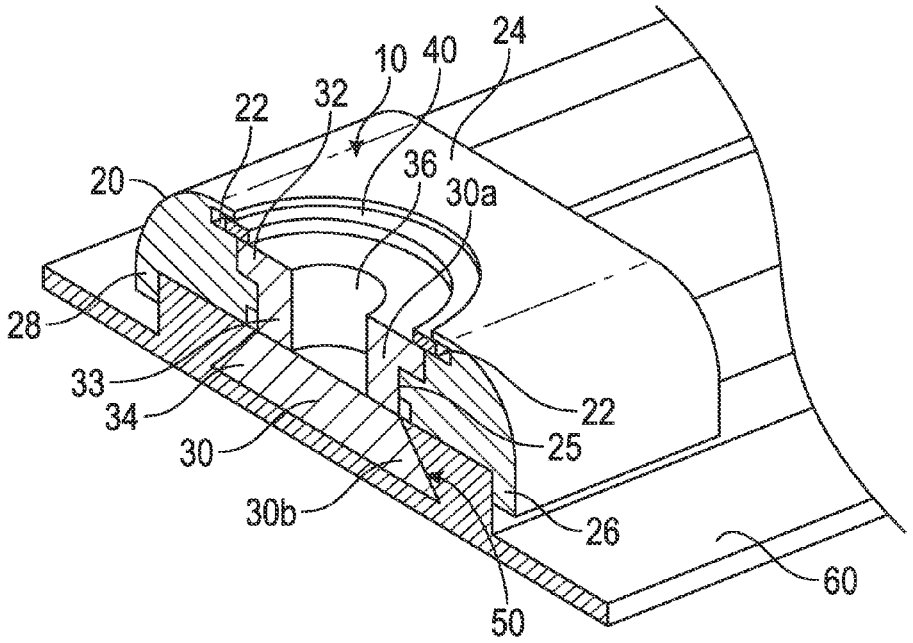
FIG. 2 is a cross-sectional view of the slidable weight assembly shown in FIG. 1 along lines 2-2.
Figure 3:
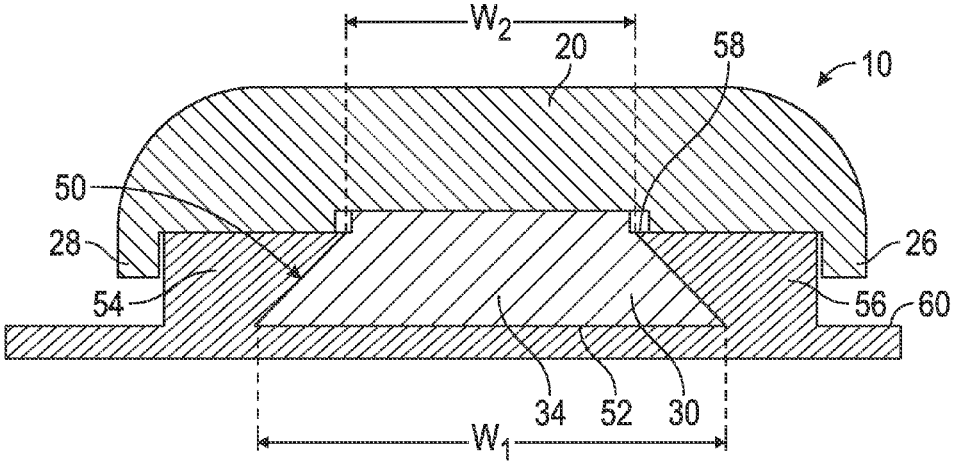
FIG. 3 is a cross-sectional view of the slidable weight assembly shown in FIG. 1 along lines 3-3.

As shown in FIG. 2, the base 30 has an approximately hourglass-shaped cross section, with an upper lip 32 having a diameter greater than a neck 33 but less than the length L or width W of the foot 34. The weight portion 20 comprises a through bore 25 with a diameter that is greater than that of the neck 33 but less than the upper lip 32 and the foot 34, such that, when the slidable weight assembly 10 is fully assembled, at least a part of the weight portion 20 is trapped on the base 30 between the upper lip 32 and the foot 34 of the base 30. The base 30 may be formed from two or more pieces 30*a*, 30*b* so that the neck 33 can be threaded through the through bore 25 to engage the base 30 with the weight portion 20. Once the weight portion 20 is threaded in such a way, the two or more pieces 30*a*, 30*b* can be permanently bonded together with an epoxy, welding, soldering, or any other means known to a person skilled in the art. The weight portion 20 also comprises a narrow, ring-shaped recess 22 near its uppermost surface 24 that is sized to receive the retainer ring 40.

The slidable weight assembly 10 disclosed herein may be used with any of the channels disclosed in U.S. patent application Ser. No. 14/033,218, which is hereby incorporated by reference in its entirety herein, and preferably is used with a channel 50 having a first width $W_1$ at its floor 52 that is greater than a second width $W_2$ at its uppermost opening 58 as shown in the Figures herein. Though the slidable weight assembly 10 may be assembled as described above, with the base 30 formed from two or more pieces 30*a*, 30*b* and assembled within the channel 50, the channel 50 preferably leads to an opening or pocket where the base 30 of a fully-assembled slidable weight assembly 10 can be inserted into the channel 50, as disclosed in U.S. patent application Ser. No. 14/033,218. As shown in FIGS. 1-4, the channel 50 comprises a floor 52 and two hooked edges 54, 56 that extend upwards and towards each other, leaving an uppermost opening 58 from which the slidable weight assembly 10 extends. The hooked edges 54, 56 of the channel 50 also preferably extend upwards and away from a body 60 of whatever the channel 50 is affixed to, such that the edges 54, 56 can function as rails. The weight portion 20 preferably includes hooked edges 26, 28 that overhang the hooked edges 54, 56 of the channel 50, and thus help guide the slidable weight assembly 10 along the channel when it is in an unlocked configuration.

Figure 4:
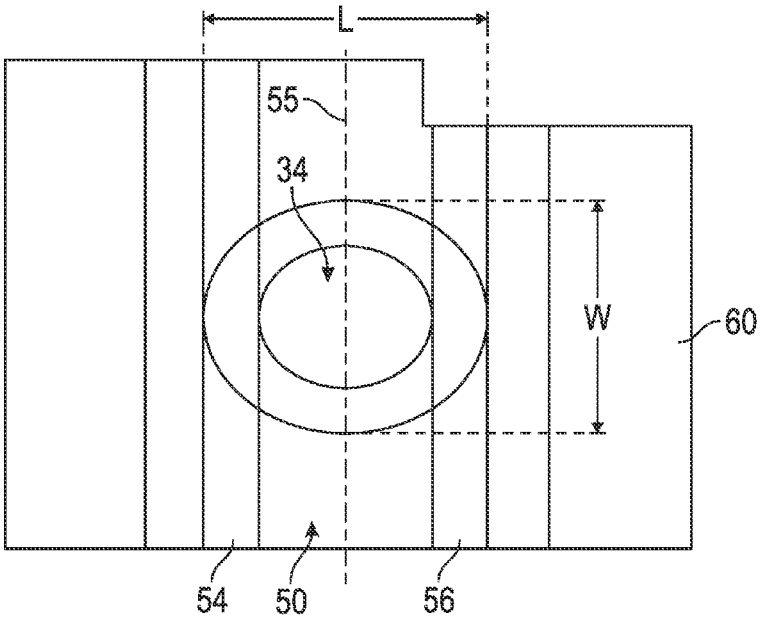
FIG. 4 is a top plan view of the retaining foot portion of the slidable weight assembly shown in FIGS. 2 and 3 disposed within the channel, which is shown in transparent form so that the entirety of the foot portion is visible.
Figure 5:
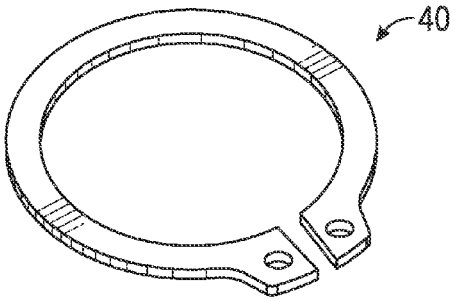
FIG. 5 is a side perspective view of the retaining ring shown in FIG. 2.
Figure 6:
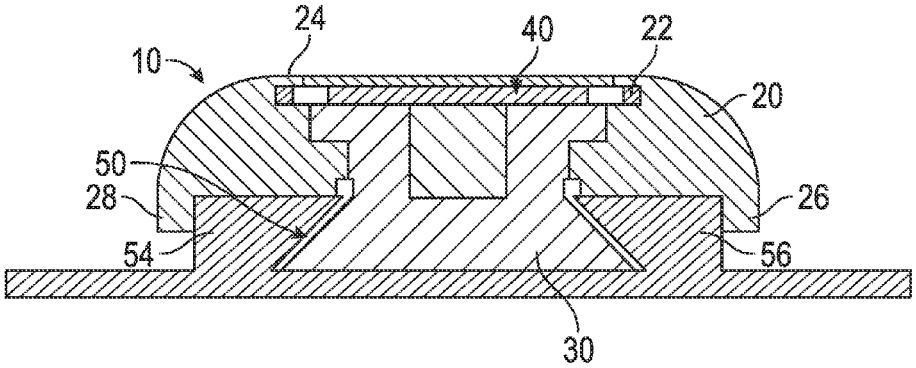
FIG. 6 is a cross-sectional view of the slidable weight assembly shown in FIG. 1 along lines 6-6 in its unlocked configuration.
Figure 7:
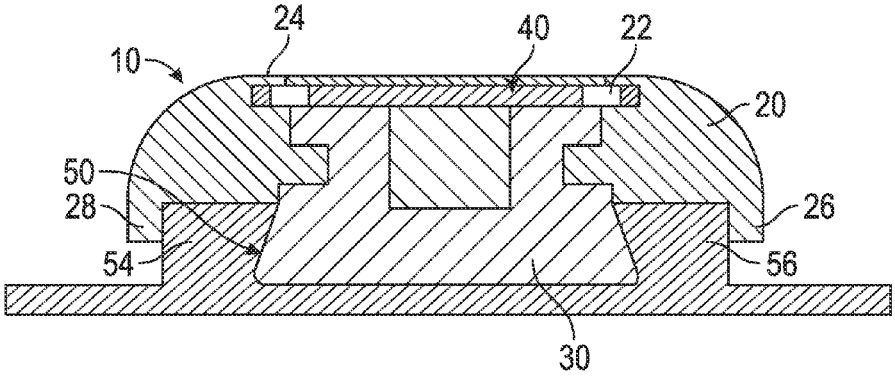
FIG. 7 is a cross-sectional view of the slidable weight assembly shown in FIG. 1 along lines 7-7 in its locked configuration.
Figure 8:
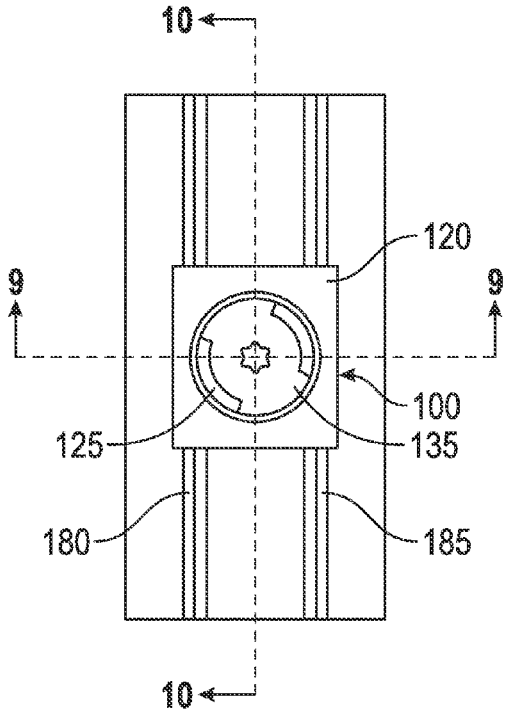
FIG. 8 is a top plan view of a second embodiment of the slidable weight assembly of the present invention engaged with a pair of rails.

The slidable weight assembly 10 can move freely within the channel 50 when the foot 34 of the base 30 is oriented such that its longest dimension is aligned with the longitudinal axis 55 of the channel 50, as shown in FIG. 6. In this configuration, the slidable weight assembly 10 is in its unlocked configuration. The hooked edges 54, 56 still overhang the foot 34 of the base 30 in this configuration, but the foot 34 does not place any pressure on the channel's 50 hooked edges 54, 56 or create much friction. Once the slidable weight assembly 10 is moved to a desired location within the channel 50, it is fixed or locked into that location by inserting a tool into the keyed bore 36 of the base 30 and turning the tool so that the base 30 makes a 90 degree turn, such that the longest dimension of the foot 34 is perpendicular to the longitudinal axis 55 of the channel 50 and presses against the hooked edges 54, 56 of the channel 50, as shown in FIGS. 4 and 7. In this locked configuration, the base 30 may be fixed in place by friction created between the sides of the foot 34 and the hooked edges 54, 56, as shown in FIG. 4, and/or the foot 34 may place so much pressure on the hooked edges 54, 56 that it pushes them away from each other and compresses them as shown in FIG. 7. Either way, locking the base 30 as described removably fixes the slidable weight assembly 10 within the channel 50. Locking the base 30 as described also pulls the weight portion 20 downwards towards the floor 52 of the channel 50, placing pressure on the uppermost sides of the hooked edges 54, 56 and creating friction between them and the weight portion 20.

Figure 12:
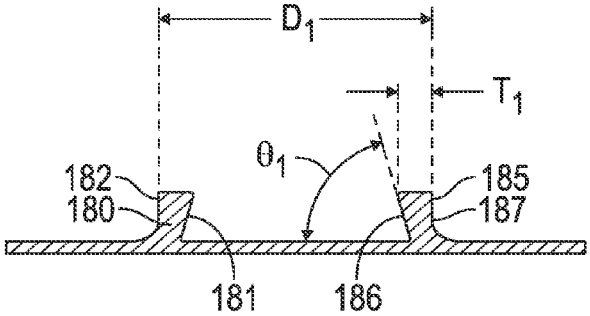
FIG. 12 is a cross-sectional view of the rails shown in FIG. 11 along lines 12-12.

A second, preferred embodiment of the present invention is shown in FIGS. 8-22. This embodiment generally functions in the same way as the first embodiment, but does not require a retainer ring to hold the pieces of the slidable weight assembly 100 together. The slidable weight assembly 100 shown in FIGS. 8-22 comprises a weight portion 120 with a keyed opening 125 and a cam 130 with a keyed top 135 that fit together to grip a pair of rails 180, 185 extending from a surface of a golf club head (not shown). The rails 180, 185 preferably have angled inner walls 181, 186 as shown in FIG. 12, forming an angle $\theta_1$ with the surface 190 of the golf club head that is less than 90°, more preferably between 45° and 85°, and most preferably approximately 70°. Each rail 180, 185 preferably has a thickness $T_1$ of less than 0.100 inch, and more preferably approximately 0.091 inch, and the outer walls 182, 187 of the rails 180, 185 are spaced from one another by a distance $D_1$ of between 0.500 and 1.00 inch, more preferably by approximately 0.700 inch, and most preferably by approximately 0.725 inch. The rails 180, 185 may be disposed anywhere on a golf club head, and may be disposed within a recessed area or channel so that an upper surface of the slidable weight assembly 100 is flush with most of the outer surface of the golf club head.

Figure 13:
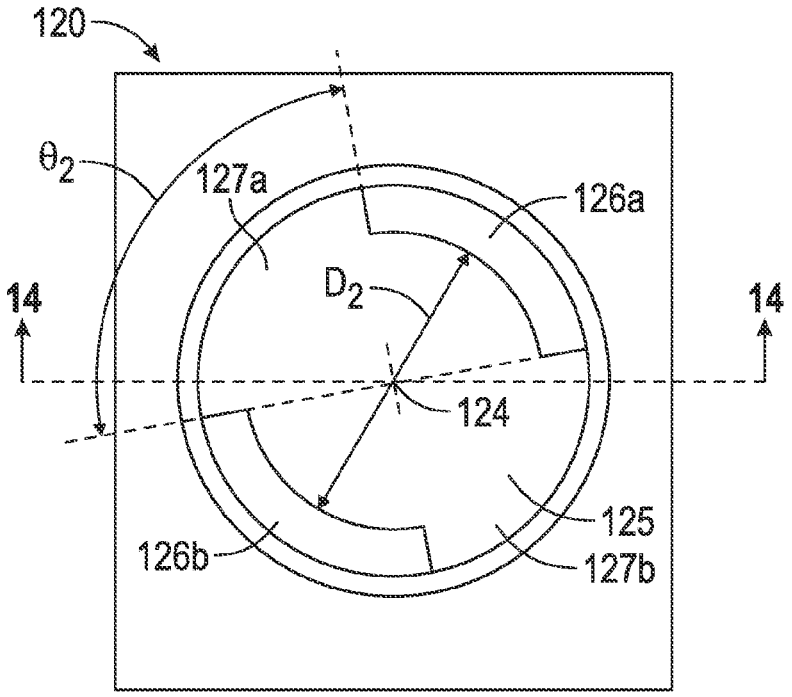
FIG. 13 is a top plan view of the weight portion of the slidable weight assembly shown in FIG. 8.
Figure 14:
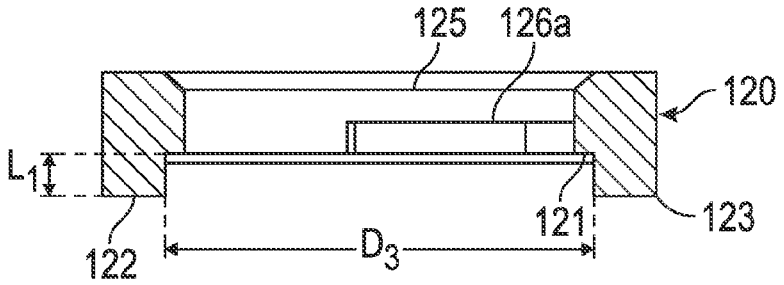
FIG. 14 is a cross-sectional view of the embodiment shown in FIG. 13 along lines 14-14.
Figure 15:
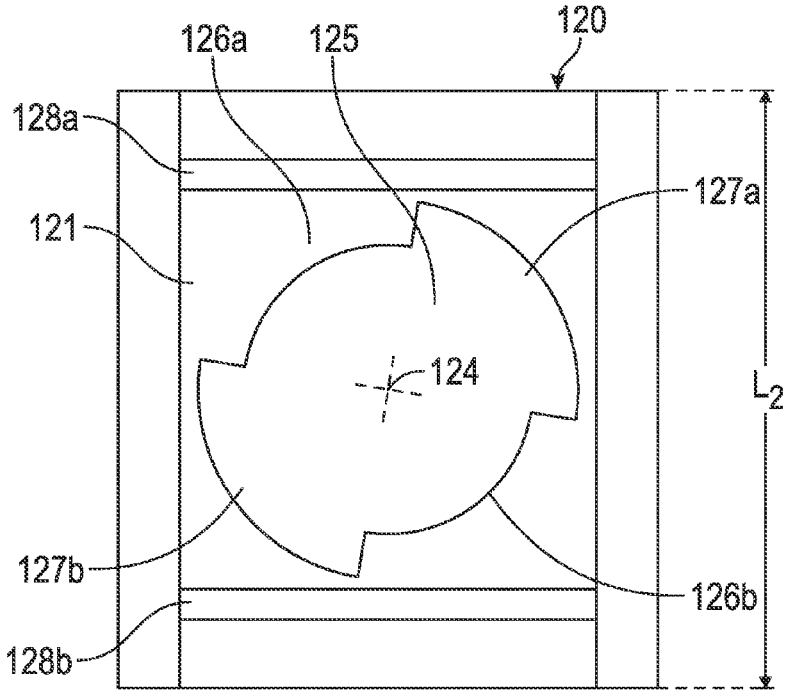
FIG. 15 is a bottom plan view of the embodiment shown in FIG. 13.

The weight portion 120 of the slidable weight assembly 100 is shown in greater detail in FIGS. 13-17. As shown in FIGS. 13-15, the keyed opening 125 of the weight portion 120 includes a pair of extensions 126*a*, 126*b* that extend inwards from a lower surface 121 of the weight portion 120 and are spaced from one another at a center point 124 of the keyed opening 125 by a distance $D_2$ of approximately 0.500 inch. The extensions 126*a*, 126*b* preferably are spaced from one another by gaps 127*a*, 127*b* having an angle $\theta_2$ of approximately 90°. The weight portion 120 also includes a pair of hooked edges 122, 123 sized to fit around the rails 180, 185. The hooked edges 122, 123, which have a length $L_1$ of less than 0.100 inch, and more preferably of approximately 0.075 inch, preferably are spaced from one another by a distance $D_3$ of between 0.500 and 1.00 inch, more preferably by approximately 0.700 inch, and most preferably by approximately 0.735 inch. In any event, $D_3$ is preferably at least 0.005 inch greater than $D_1$, and more preferably at least 0.010 inch greater than $D_1$ to allow the weight portion 120 to slide smoothly over the rails 180, 185.

Figure 16:
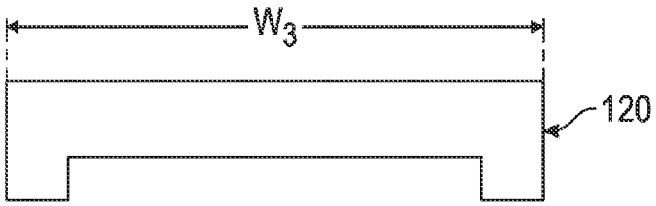
FIG. 16 is a front plan view of the embodiment shown in FIG. 13.
Figure 17:
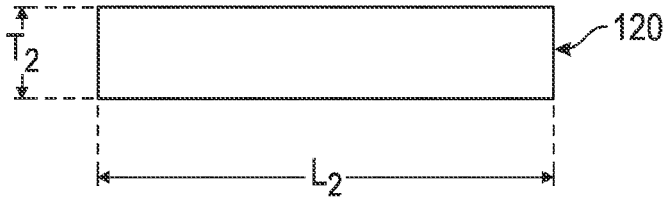
FIG. 17 is a right side plan view of the embodiment shown in FIG. 13.
Figure 18:
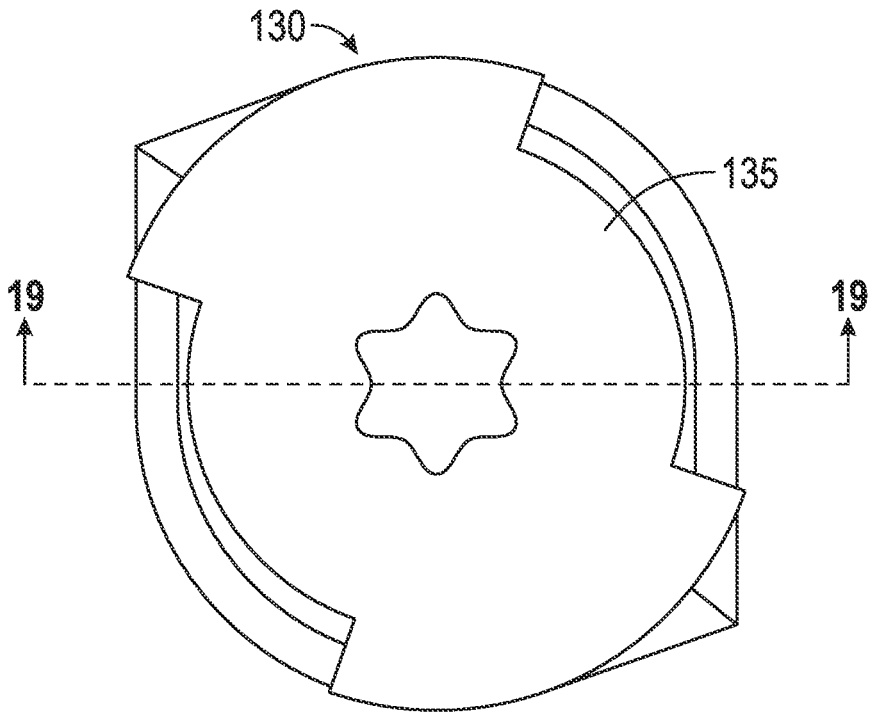
FIG. 18 is a top plan view of the cam portion of the slidable weight assembly shown in FIG. 8.
Figure 19:
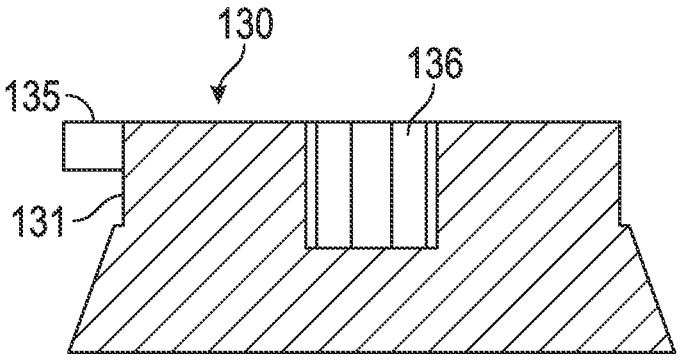
FIG. 19 is a cross-sectional view of the embodiment shown in FIG. 18 along lines 19-19.
Figure 20:
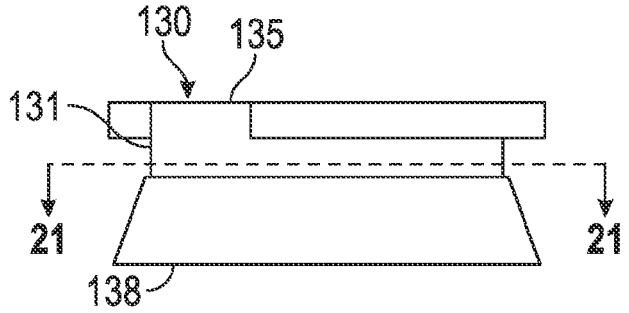
FIG. 20 is a side plan view of the embodiment shown in FIG. 18.
Figure 21:
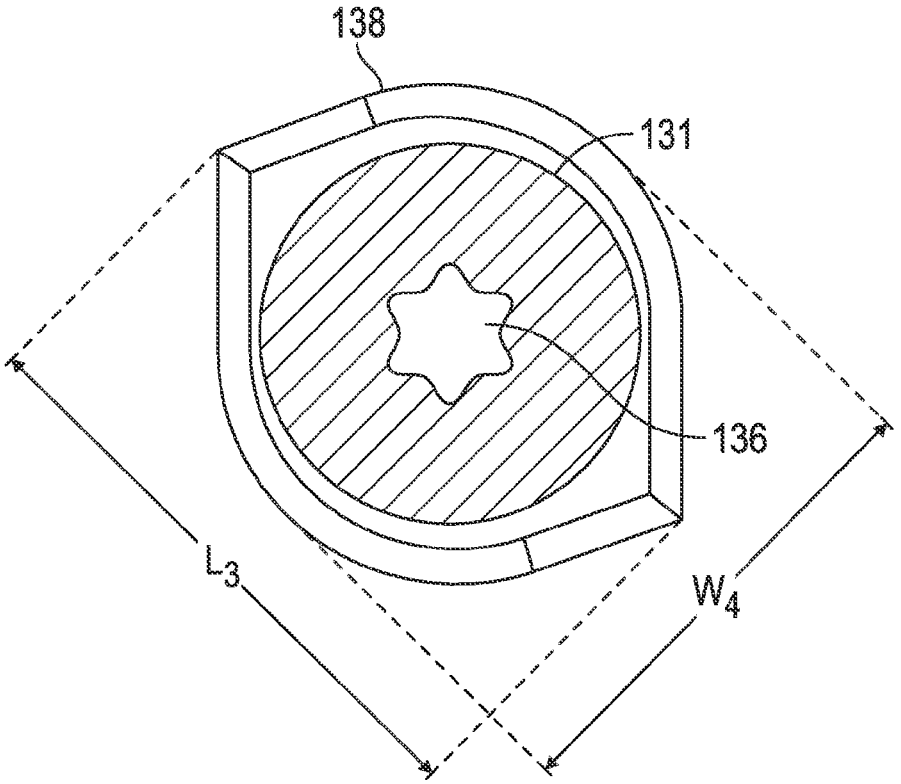
FIG. 21 is a cross-sectional view of the embodiment shown in FIG. 20 along lines 21-21.
Figure 22:
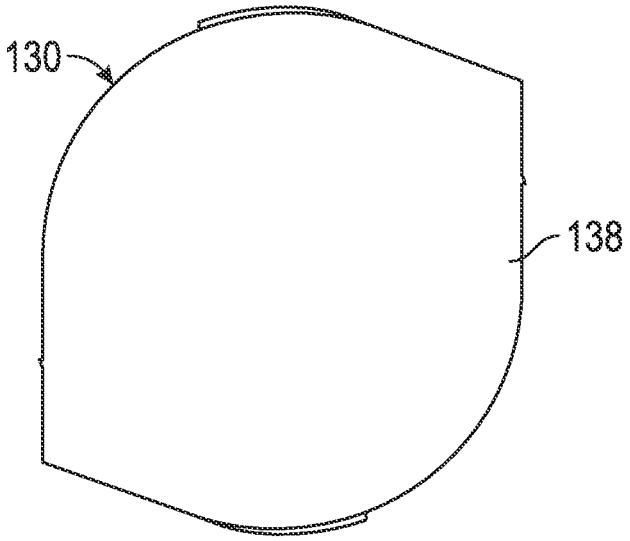
FIG. 22 is a bottom plan view of the embodiment shown in FIG. 18.

As shown in FIGS. 15-17, the weight portion 120 preferably has a length $L_2$ of approximately 1 inch, a width $W_3$ of approximately 0.90-0.95 inch, an overall thickness $T_2$ (including the hooked edges 122, 123) of approximately 0.200 inch, and includes a pair of small rails 128*a*, 128*b* extending from the lower surface 121. These small rails 128*a*, 128*b* rest against, and space the lower surface 121 from, the rails 180, 185 extending from the golf club head when the slidable weight assembly 100 is engaged with the rails 180, 185.

Figure 9:
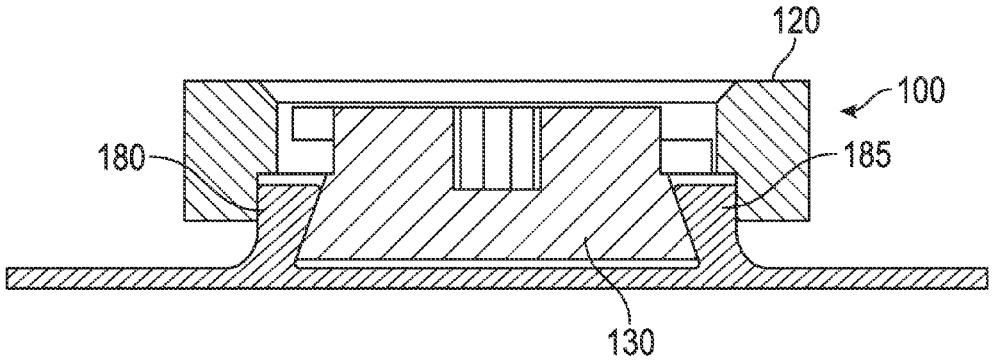
FIG. 9 is a cross-sectional view of the embodiment shown in FIG. 8 along lines 9-9.
Figure 10:
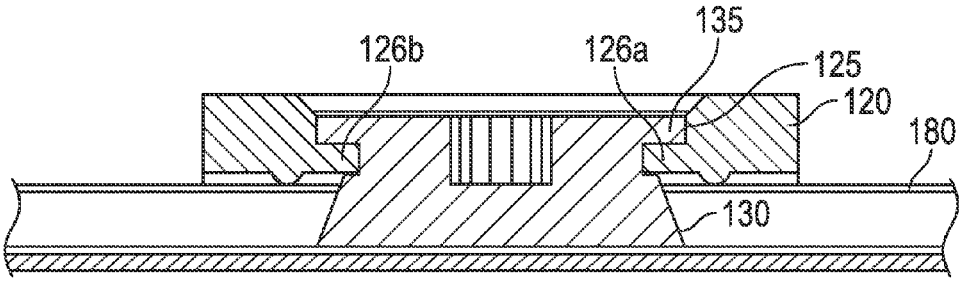
FIG. 10 is a cross-sectional view of the embodiment shown in FIG. 8 along lines 10-10.
Figure 11:
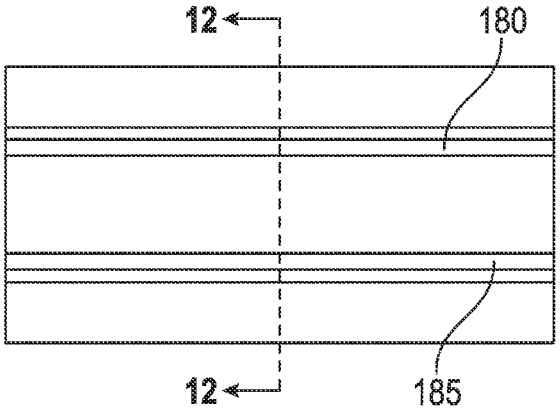
FIG. 11 is a top plan view of the pair of rails shown in FIG. 8.

The cam 130 part of the slidable weight assembly 100 is shown in more detail in FIGS. 18-22. The keyed top 135 includes a keyed bore 136 sized to receive a tool, such as a hex wrench. The keyed bore 136 extends through the keyed top 135 and into a neck 131 of the cam 130. The keyed top 135 is sized to fit within the keyed opening 125 of the weight portion 120 and slide over the extensions 126*a*, 126*b* of the weight portion 120 when rotated with a tool, as shown in FIG. 10. The cam 130 also includes an eye-shaped base 138 with a length $L_3$ that is greater than its width $W_4$, such that turning the cam 130 with a tool causes the base 138 to rotate between the rails 180, 185 and press against their inner walls 181, 186 as shown in FIG. 9 to retain the cam 130, and thus the weight portion 120, on the rails 180, 185.

As with the first embodiment, slidable weight assembly 100 can move freely between the rails 180, 185 when the base 138 of the cam 130 is oriented such that its longest dimension is aligned with rails 180, 185. In this configuration, the slidable weight assembly 100 is in its unlocked configuration. The rails 180, 185 still border the cam 130 on two sides in this configuration, but the cam 130 does not place any pressure on the rails 180, 185 or create much friction. Once the slidable weight assembly 100 is moved to a desired location between the rails 180, 185, it is fixed or locked into that location by inserting a tool into the keyed bore 136 of the cam 130 and turning the tool so that the cam 130 makes a 45 to 90 degree turn, such that the longest dimension $L_3$ of the base 138 is perpendicular to and presses against the rails 180, 185, as shown in FIG. 9. In this locked configuration, the cam 130, and thus the weight portion 120, is fixed in place by friction created between the sides of the base 138 and the rails 180, 185.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A slidable weight assembly comprising:
a weight portion comprising a through bore; and
a cam comprising a top portion, a keyed bore, a neck, and a base having a long side with a first length and a short side with a second length,
wherein the weight portion comprises a pair of hooked edges,
wherein the first length is greater than the second length,
wherein the neck is disposed within the through bore, and
wherein the keyed bore is sized to receive a tool.

2. The slidable weight assembly of claim 1, wherein the through bore has a first diameter, wherein the top portion has a second diameter, and wherein each of the second diameter, the first length, and the second length is greater than the first diameter.

3. The slidable weight assembly of claim 1, wherein the weight portion is composed of a first material having a first density, wherein the cam is composed of a second material having a second density, and wherein the first density is greater than the second density.

4. The slidable weight assembly of claim 3, wherein the weight portion is composed of a tungsten alloy and wherein the base is composed of a polymeric material.

5. The slidable weight assembly of claim 1, wherein the through bore comprises a keyed opening, wherein the top portion is shaped to fit within the keyed opening, and wherein turning the cam reversibly locks the weight portion to the cam.

6. The slidable weight assembly of claim 5, wherein the keyed opening comprises a pair of extensions extending inwards from a lower surface of the weight portion.

7. The slidable weight assembly of claim 6, wherein at least a part of the top portion rests on the extensions when the weight portion is reversibly locked to the cam.

8. A slidable weight assembly comprising:
a weight portion comprising a through bore; and
a cam comprising a top portion, a keyed bore, a neck, and a base having a long side with a first length and a short side with a second length,
wherein the first length is greater than the second length,
wherein the neck is disposed within the through bore,
wherein the keyed bore is sized to receive a tool, and
wherein the base has a shape selected from the group consisting of oval and eye-shaped.

9. A slidable weight assembly comprising:
a weight portion comprising a through bore;
a retainer ring, and
a cam comprising a top portion, a keyed bore, a neck, and a base having a long side with a first length and a short side with a second length,
wherein the first length is greater than the second length,
wherein the neck is disposed within the through bore,
wherein the keyed bore is sized to receive a tool.

10. The slidable weight assembly of claim 9, wherein the weight portion comprises a ring-shaped recess sized to receive the retainer ring.

11. A golf club head comprising:
a body comprising a first rail and a second rail that are spaced from, and extend parallel to, one another; and
the slidable weight assembly of claim 1,
wherein the first rail and second rail form a channel having a floor with a first width and an upper opening with a second width,
wherein the first width is greater than the second width,
wherein the base is disposed within the channel,
wherein the neck extends through the upper opening,
wherein a majority of the weight portion is disposed above the first and second rails,
wherein the slidable weight assembly is movable between the first and second rails when the long side of the base is oriented so that it is parallel with the first and second rails, and
wherein turning the cam by 45 to 90 degrees reversibly fixes the slidable weight assembly to the first and second rails.

12. The golf club head of claim 11, wherein the golf club head comprises a recessed area, and wherein the first and second rails are disposed within the recessed area.

13. The golf club head of claim 12, wherein the recessed area is in communication with a weight port, and wherein the slidable weight assembly is sized to fit within the weight port to access the first and second rails.

14. The golf club head of claim 11, wherein at least one of the first and second rails comprises an inner wall that forms an angle with the floor, wherein the angle is less than 90°.

15. The golf club head of claim 13, wherein the angle is between 45° and 85°.

16. The golf club head of claim 14, wherein the angle is approximately 70°.

17. The golf club head of claim 11, wherein at least one of the first and second rails has a thickness of less than 0.100 inch.

18. The golf club head of claim 11, wherein the first and second rails are spaced from one another by a distance of between 0.500 and 1.00 inch.

19. The golf club head of claim 11, further comprising a pair of small rails extending from a lower surface of the weight portion, wherein the small rails rest against, and space the lower surface from, the first and second rails.

* * * * *